US005413327A

United States Patent [19]

Reymond et al.

[11] Patent Number: 5,413,327

[45] Date of Patent: May 9, 1995

[54] DEVICE FOR ALIGNING BOX BLANKS FOR A MACHINE PROCESSING BOX BLANKS

[75] Inventors: Jacques Reymond, Gland; Jean L. Wenger, Grandvaux, both of Switzerland

[73] Assignee: Bobst SA, Lausanne, Switzerland

[21] Appl. No.: 187,534

[22] Filed: Jan. 28, 1994

[30] Foreign Application Priority Data

Feb. 9, 1993 [CH] Switzerland ..... 387/93

[51] Int. Cl.[6] ..... B65H 9/16

[52] U.S. Cl. ..... 271/251; 271/253; 271/274; 271/275

[58] Field of Search ..... 271/251, 273, 274, 275, 271/253

[56] References Cited

U.S. PATENT DOCUMENTS

| | | | |
|---|---|---|---|
| 2,190,416 | 2/1940 | Davidson | 271/251 |
| 3,519,266 | 7/1970 | Blake et al. . | |
| 3,709,484 | 1/1973 | Kistner | 271/251 |
| 4,163,550 | 8/1979 | Armstrong | 271/274 |
| 4,836,527 | 6/1989 | Wong . | |
| 5,019,026 | 5/1991 | Jaton . | |

FOREIGN PATENT DOCUMENTS

| | | |
|---|---|---|
| 0381845 | 8/1990 | European Pat. Off. . |
| 678707 | 10/1991 | Switzerland . |

*Primary Examiner*—Cheryl L. Gastineau
*Assistant Examiner*—Boris Milef
*Attorney, Agent, or Firm*—Hill, Steadman & Simpson

[57] ABSTRACT

A device for aligning box blanks in a box blank processing machine including a frame supporting a lengthwise guiding rail, an upper carrier and lower carrier which are directly interconnected by brackets and have one end pivotably mounted to the frame adjacent an exit end of the device so that the entrance end of the carriers can be spaced from the rail to provide a lateral movement of a blank against the rail. The position of the entrance end of the carriers is adjustable relative to the guide rail. The upper carrier preferably is formed of a series of rollers and the lower carrier has a series of rollers supporting a belt which is driven by a drive pulley.

5 Claims, 1 Drawing Sheet

DEVICE FOR ALIGNING BOX BLANKS FOR A MACHINE PROCESSING BOX BLANKS

BACKGROUND OF THE INVENTION

The present invention is directed to a device for aligning box blanks in a machine for processing box blanks, for example in a folder-gluer.

A folder-gluer is a machine in which the box blanks are taken one-by-one from underneath a pile and carried through various folding and/or gluing sections by means of belt conveyors in order to finally be gathered flat-folded and glued in a delivery station. These operations may take place in the following chronological order: prebreakage of the first and third blank creases, rearranging the blank the blank so as to have it lie completely flat in the next section, applying a glue, folding the blank along its second and fourth creases, applying pressure to have the glued portion adhere to a portion of the box, and then ejection. At the end of this section, every folded blank is piled in the last section called the delivery station.

In order to obtain an accurate fold along every predetermined crease, it is necessary that the transportation of the box blank through the machine is achieved with neither sidewise nor lengthwise sliding. To this aim, use is made of combined lower and upper belt carriers as well as, in certain cases, a combination of one or several lower belt carriers with an upper ramp or base element which supports pressure rollers.

One of the main problems is the inaccurate blank introduction into the machine. The introduction device usually consists of a lower carrier with multiple belts associated therewith and with a front gauge or gate which coacts with the carrier belt to form a slot which allows only one blank at a time to be passed therethrough. In addition, sidewise positioning jaws, which are adjustable on account of the size of the blanks, are provided.

The sequential feed-in of the blanks can then be achieved by means of elements which act so as to partially and temporarily obstruct the slot extending between the carrier belts and the lower end of the front gauge or gate and, thus, prevent the travelling motion of the lower blank of the pile which is located in the introduction device. The travelling of the blank to be introduced results from the fact that the adherence of its lower surface to the carrier belt is much greater than the friction on its upper surface against the lower surface of the next blank in the pile.

However, when the belts become dirty, they will induce discrepancies in the amount of friction at different locations and, hence, an imbalance of the frictional forces over the width of the belts. This imbalance will cause a skewing of the blank as it is introduced into the machine and causes inaccuracies in the position of the blank in the folding station or section and, therefore, jeopardizes obtaining the folds along the desired creases.

Devices for correcting such an inaccurate alignment are known and are preferably placed in the section which is located just after the introduction device. One of the known alignment correcting devices, also called a rectifier, includes a series of lower and upper rollers arranged in a quincunx on a lower beam and an upper beam which may be separated from one another in order to have the thickness of the travelling blank be taken into account or consideration. The rollers of the upper and lower beams are driven by means of a unique flat belt which will transmit its travelling motion through the medium of pulleys fitted on the axle of every roller. The device which will allow the separating of one beam from the other will include, among other things, a device which insures a permanent and variable pressure application of the upper rollers on the blank upper surface. Furthermore, the upper and lower beams are arranged in a definite and invariable angle with regard to the lengthwise axis of the machine.

The device includes, moreover, a lengthwise guiding rail. Because of the angle of the upper and lower beams, the rollers act on one of the sides of the travelling blank and cause the application or movement of its edge against the lengthwise guiding rail. This true alignment has the effect of placing the blank in a desired position so that the creases will be perfectly parallel to the lengthwise axis of the machine.

However, the funnel-type effect thus created may, in certain cases, apply too much pressure on the blank to force it against the lengthwise guiding rail and cause damage to the edge of the blank. Moreover, it is necessary to manually adjust the room left at the entrance of the rectifier between the blank edge and the lengthwise guiding rail. This adjustment is variable on account of the blanks quality and cannot be easily automated. Another drawback remains in the fact that the action of the upper rollers on the blank takes place between the lower rollers and not on their vertical axes and, thus, this action tends to corrugate or bend the blank which will impair the blank's true alignment in case of excessive pressure application. Finally, this type of rectifier has to be removed from the machine if its use is not acceptable for the box blanks being processed. The dismantling and transforming of the rectifier from the folder-gluer section will consume considerable time and, thus, cause the machine to be out of service.

U.S. Pat. No. 5,019,026, whose disclosure is incorporated herein by reference thereto and which claims priority from the same Swiss Application that resulted in Swiss Patent 678 707, describes another device for aligning box blanks. This device includes a movable lengthwise guiding rail, a lower endless belt which is driven and supported by rollers and a row of upper rollers, each of which is fitted on the end of a lever which pivots around a horizontal axis. The lever itself is attached to a support which will pivot around a vertical axis. The ends of every horizontal lever axle is equipped with a flexible element which is attached to a corner member that can be moved horizontally relative to a fixed lengthwise beam secured to the frame of the machine so that each of the supports for the levers of the rollers can be pivoted to change the angle of attack of the rollers relative to the guiding rail. The pressure adjustments of the upper rollers is achieved by means of a primary spring located between the pivoting lever and a guide rod which is fixed on a ramp or base element which, in turn, is fitted on the fixed lengthwise beam owing to secondary springs which surround a threaded adjustment rod screwed on the lengthwise beam.

Functioning almost properly, this device, however, is expensive to construct, since it relies on each roller associated to its lever to be provided with an individual pivot support, a flexible element completing each pivoting in the vertical direction as well as a special corner piece which is horizontally movable in order to force the simultaneous pivoting of all of the levers.

SUMMARY OF THE INVENTION

The present invention is directed to a device for aligning box blanks which will insure a true and repetitive alignment. This action is executed with an easy force and can be easily adjusted when the machine is to be changed from one kind of blank to another. In other words, the structure is comparatively simple so as to allow a realization and construction at low cost.

These objects are achieved in a device for aligning box blanks in a box blank processing machine, said device comprising a frame, a lengthwise guiding rail fixedly mounted on the frame, an upper carrier and a lower carrier, brackets directly connecting the upper and lower carriers in fixed relationship with each other to provide an entrance end and an exit end, pivot means for pivotably mounting the exit end of the lower carrier in the frame for pivotable movement around a vertical axis adjacent the guide rail, and adjustment means for positioning the entrance end of the carrier relative to the guide rail to enable changing the angle of a path of the carriers relative to the alignment rail. The adjustment means can be either mechanical or electromechanical and can change the position with a predetermined rate.

According to a preferred way of forming the construction, the lower carrier consists of an endless belt which is supported by lower rollers and in combination the upper carrier consists of a row of upper rollers which are mounted on the ends of levers which pivot around the horizontal axis and whose other end is fitted on a base element which, in turn, is connected to an upper lengthwise beam by adjustable means for positioning the height of the base element relative to the upper lengthwise beam, so that the upper rollers are vertically positioned relative to the lower rollers. Advantageously, each lever carries two rollers which are spaced apart to form a lengthwise pair of rollers.

The belt is usefully driven by a drive pulley and is provided with tension means for maintaining the tension on the belt. The tension means which provides elastic tension along with the drive pulley are both mounted on a neighboring vertical base plate of the frame and the belt is twisted by a half-turn prior to entering the drive pulley and is, again, twisted a half-turn in the opposite direction after exiting the drive pulley and tensioning means and before returning to the rollers supporting the belt.

The upper rollers pressure is usually applied, on one hand, by means of helical springs arranged between the pivoting levers and the guide rods mounted on the base element or by means of a vertical fiat spring surrounding the horizontal pivot axis of the lever and the spring has a branch acting on the upper surface of the lever and the other branch acting against an inner wall of the base element. To connect the base element or ramp to the upper lengthwise beam, the connecting means can consist of a threaded adjustment rod which is threaded onto the base element and fitted to the lengthwise beam by a pair of knurled knobs engaged on the rod.

Other advantages and features of the invention will be readily apparent from the following description of the preferred embodiments, the drawings and claims.

DESCRIPTION OF THE PREFERRED EMBODIMENTS

Figure 3:
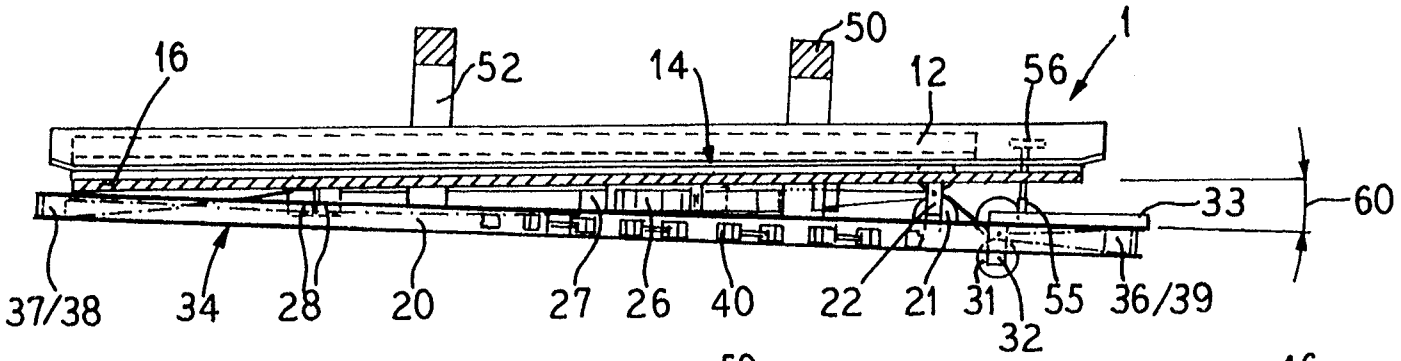
FIG. 3 is a cross sectional view with portions in elevation for purposes of illustration taken along the lines III—III of FIG. 1.
Figure 2:
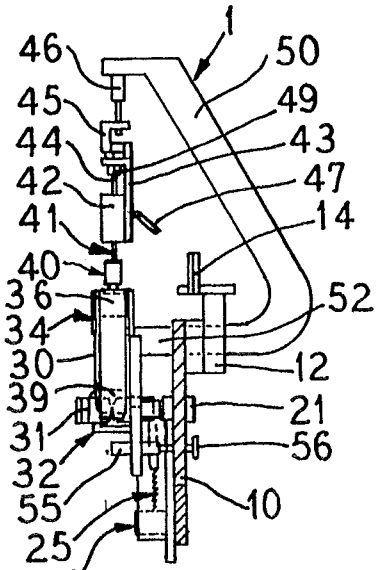
FIG. 2 is a schematic end view taken from the right end of FIG. 1 with portions broken away for purposes of illustration.
Figure 1:
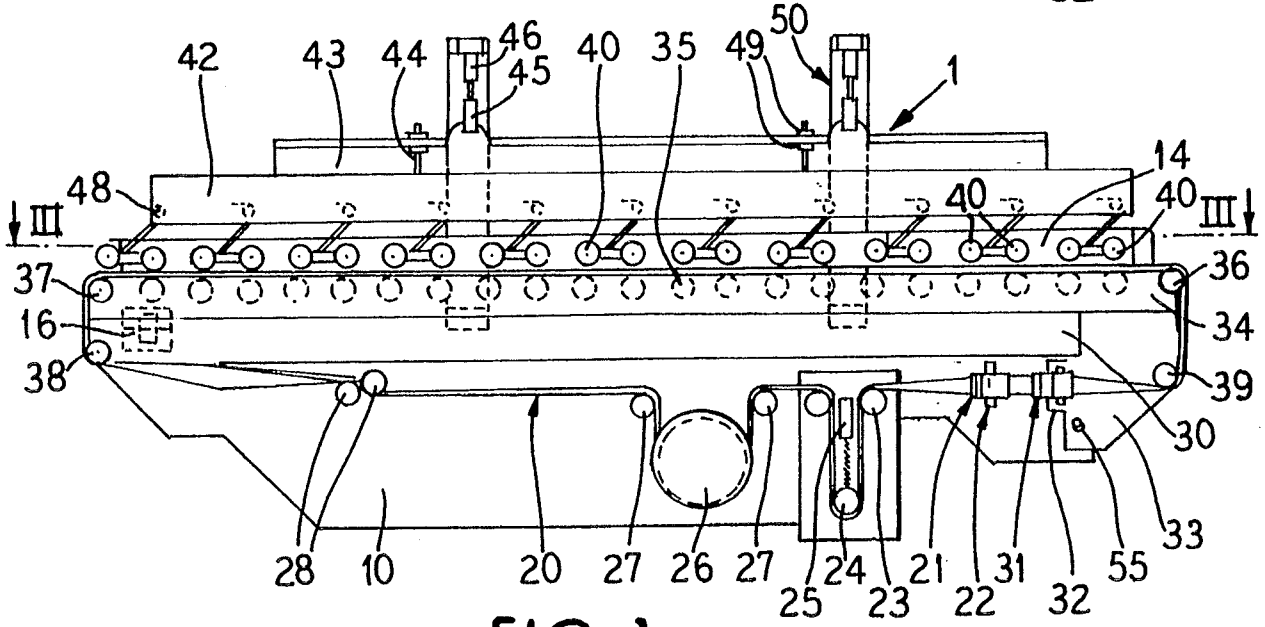
FIG. 1 is a schematic side view of the device for aligning box blanks in accordance with the present invention.

The principles of the present invention are particularly useful when incorporated in a device for aligning, generally indicated at 1 in FIGS. 1, 2 and 3. The device 1 includes a vertical plate 10 which is attached to a section frame and whose upper part carries a lengthwise extending beam 12 (FIGS. 2 and 3) on which a lengthwise guiding rail 14 is held by means of fasteners, such as screws (not represented), which allow a certain lateral adjustment. On the left-hand side of the vertical plate 10, as shown in FIG. 1, a lower lengthwise beam 30 is arranged and is mounted for pivotable movement around a vertical pivot 16 at the level of its so-called exit end. The beam 30 is supported over its length by one or several crossbars which are arranged laterally to the underlying lengthwise beam and are not illustrated, but are attached to the vertical plate 10. The so-called entrance end, which is located on the right hand side of FIG. 1 and is visible in FIG. 2 is, as desired, movable crosswise by means of a screw 56 which maintains in a vertical plate 10 and engaged in a threaded ring 55 belonging to an extension plate 33 of the lengthwise beam 30. The arrangement of the screw 56 and threaded ring 55 which allows the movement of the entrance end of the lower lengthwise beam 30 from a vertical plate 10 and, hence, from the guiding rail 14, may advantageously be replaced by any other pneumatic or electromechanical actuator. The top of the lengthwise beam 30 carries a lower belt carrier which consists of a row of lower rollers 35 held by two lateral jaws or plates 34 and above which an endless belt 20 travels. To drive the belt 20, a drive pulley 26 associated with idler or return pulleys 27 as well as a tension pulley 24 associated with two return or idler pulleys 23 and means 25 for applying a tension are both mounted on the basic plate 10 so as to underlie the lower lengthwise beam 30. The means 25 for applying tension may consist of a spring or a gas or air cushion whose upper point of support is adjustable in height.

The flat endless belt 20 travels over the row of lower rollers 35 after it passes over an entrance pulley 36 and leaves the row through an exit pulley 37 which directs it toward the bottom where it leads toward a lower return pulley 38. After the belt passes over the pulley 38, it is twisted through half a turn and is received by a pair of pulleys 28 which firmly engage the belt at this level and, thus enables the belt to be led directly toward the return pulleys 27 of the drive pulley 26 and then to the tension appliance which consists of the pulleys 23 and 24. After passing the second pulley 23, the belt is again twisted through half a turn by two pairs of pulleys, which include a first pair of vertical pulleys 21 which rotate on the vertical axis and which are mounted on the base plate 10 by means of supports 22. A second pair of vertical pulleys 31, which also rotate on the vertical axis, are mounted on the extension plate 33 of the lower lengthwise beam 30 by supports 32. The belt 20 is then finally returned to its regular orientation as it reaches the lower return pulley 39 and goes to the entrance pulley 36.

One of the main aspects of the present device is the occurrence of these two twisted belt parts which forced the belt to temporarily take up a vertical orientation at the moment it passes from the running path of the rotatable lower lengthwise beam 30 to a path running along the fixed vertical base plate 10. The potential room between the lower lengthwise beam and the vertical plate is smaller at the exit end, i.e., the left-hand side of FIG. 1. Thus, the combination of the lower return pulley 38 and a single pair of pulleys 28 has proven to be sufficient. However, the room or space is much bigger at the entrance end, i.e., the right-hand side of FIG. 1, and, therefore, the device with the double pair of pulleys 21 and 31 has proven to be preferred.

The device according to the invention includes, in addition, an upper roller carrier held rigidly in correspondence with the lower carrier or belt carrier. For this purpose the upper carrier is hooked on a pair of balks or brackets 50, whose horizontal bases 52 are directly connected to the lower lengthwise beam 30 of the lower carrier. Thus, both the upper and lower carriers will move simultaneously as they pivot around the pivot 16, as indicated by the double-arrows 60 in FIG. 3.

The upper carrier includes a row of spaced apart pairs of rollers 40, with each pair being held or supported by a lever 41 which pivots around the horizontal axis to move the rollers in a vertical direction. The upper axle of every lever is held in a base element or ramp 42 by a crosswise horizontal axle. Every lever 41 is elastically brought down toward the bottom by means of a biasing means, such as a supporting spring 48, which, as in the illustrated example, has the shape of a double- or triple-wound element which ends on either side with a branch which may work elastically in rotation. These springs are arranged either around the axle of the lever or around a neighboring crosswise axle so as to shift or pivot the levers around the horizontal axles. A first branch will rest on an upper surface of the lever and the other branch will rest on an upper inner wall of the base element 42.

The base element 42 itself is mounted to an upper lengthwise beam 43 by means which allow adjustment in its height. For instance, in such an example, the base element is pressed against the upper lengthwise beam by a turning handle 47 (FIG. 2). Two threaded rods are permanently threaded in the upper surface of the base element 42 and extend through the upper lengthwise beam 43, where they are held on either side by means of a pair of knurled knobs 49. The adjustment in height is achieved by loosening these knurled knobs along their respective threaded rods. The locking into adjusted position comes forth by tightening these two knurled knobs against the upper wings of a lengthwise beam 43 and then by tightening the turning handle 47. The upper lengthwise beam is, itself, held by means of a stirrup piece 45 on a lever appliance 46, whose upper end is attached to the brackets 50. This appliance 46 allows by acting on a handle to upwardly disengage the upper carrier in order to free blanks which may be caught between the two carriers when a jam occurs.

When starting with the new series of blanks, the operator may adjust, on the one hand, the angle between the guide rail and the coupled upper and lower carriers by acting on the screw 56 and, on the other hand, the pressure applied by the upper rollers 40 by releasing the turning handle 47 as well as by acting on the knurled knobs 49 engaged on the threaded rods 44. These adjustments are done and are based on the type of blank being processed. The operator can, thus, adopt either a small angle and a high pressure for paper board which can withstand such a pressure or, on the contrary, a large angle and a low pressure for fragile blanks having, for instance, printed motifs on one of the surfaces.

As may be easily understood, the blank arriving askew will be guided by the combination of the lower and upper carriers with a lateral component until the blank touches the guiding rail 14 where it will automatically take up a true alignment. This guiding rail compensates for further or additional lateral force of the carrier which then influences the blank with a light frictional force.

Although various minor modifications may be suggested by those versed in the art, it should be understood that we wish to embody within the scope of the patent granted hereon all such modifications as reasonably and properly come within the scope of our contribution to the art.

We claim:

1. A device for aligning box blanks in a box blank processing machine, said device comprising a frame, a lengthwise guide rail fixedly mounted on the frame, an upper carrier and lower carrier, brackets directly connecting the upper and lower carriers in a fixed relationship to one another to provide an entrance end and an exit end, pivot means for pivotably mounting the exit end of the lower carrier on the frame for pivotable movement around a vertical axis adjacent the guide rail, adjustment means for positioning the entrance end of the upper and lower carriers relative to the guide rail to enable changing the angle of the path of the upper and lower carriers relative to the guide rail, the lower carrier comprising an endless belt which is supported by lower rollers, the upper carrier comprising a row of upper rollers and a plurality of levers, each of the levers on an end carrying a pair of the upper rollers spaced apart in the direction of movement of the endless belt, each of the levers having an opposite end mounted for pivotable movement on a horizontal axis on a base element which itself is attached to an upper lengthwise beam by a second adjustment means for positioning the upper rollers in the vertical direction relative to the lower rollers.

2. A device for aligning box blanks in a box blank processing machine, said device comprising a frame, a lengthwise guide rail fixedly mounted on the frame, an upper carrier and lower carrier, brackets directly connecting the upper and lower carriers in a fixed relationship to one another to provide an entrance end and an exit end, pivot means for pivotably mounting the exit end of the lower carrier on the frame for pivotable movement around a vertical axis adjacent the guide rail, adjustment means for positioning the entrance end of the upper and lower carriers relative to the guide rail to enable changing the angle of the path of the upper and lower carriers relative to the guide rail, the lower carrier comprising an endless belt being supported by lower rollers, a drive pulley for driving the endless belt and tension means including a tension pulley acting on the belt, said drive pulley and tension pulley being mounted on a neighboring vertical base plate of the frame, first means for twisting the belt by a half-turn before reaching the drive pulley and tension pulley, second means for twisting the belt by a half-turn in the opposite direction after leaving the drive pulley and tension means, said first and second means providing a vertical portion in a path of the endless belt on each side of the drive pulley, and the upper carrier comprising a row of upper rollers which are mounted on the ends of levers which have an opposite end mounted for pivotable movement on a horizontal axis on a base element which itself is attached to an upper lengthwise beam by a second adjustment means for positioning the upper rollers in the vertical direction relative to the lower rollers.

3. A device according to claim 2, wherein each of the levers carries a pair of the upper rollers spaced apart in the direction of movement of the endless belt.

4. A device according to claim 2, wherein the second means includes two pairs of pulleys spaced apart, with one pair being mounted on the vertical base plate and the second pair being mounted on an extension of a lower beam of the lower carrier.

5. A device for aligning box blanks in a box blank processing machine, said device comprising a frame, a lengthwise guide rail fixedly mounted on the frame, an upper carrier and lower carrier, brackets directly connecting the upper and lower carriers in a fixed relationship to one another to provide an entrance end and an exit end, pivot means for pivotably mounting the exit end of the lower carrier on the frame for pivotable movement around a vertical axis adjacent the guide rail, first adjustment means for positioning the entrance end of the upper and lower carriers relative to the guide rail to enable changing the angle of the path of the upper and lower carriers relative to the guide rail, the lower carrier comprising an endless belt which is supported by lower rollers, the upper carrier comprising a row of upper rollers which are mounted on the ends of levers which have an opposite end mounted for pivotable movement on a horizontal axis on a base element which itself is attached to an upper lengthwise beam by second adjustment means for positioning the upper rollers in the vertical direction relative to the lower rollers, wherein the pressure exerted by the upper rollers onto a blank being controlled by the second adjustment means in cooperation with vertical flat springs surrounding a horizontal pivoting axle of each lever, each of said springs having one branch acting on an upper surface of the lever and the other branch acting against an inner wall of the base element, said second adjustment means including a threaded adjustment rod attached to the base element and threadably received in the upper lengthwise beam to enable changing the distance between the base element and the endless belt of the lower carrier.

* * * * *